US006708828B2

(12) United States Patent
Miles

(10) Patent No.: US 6,708,828 B2
(45) Date of Patent: Mar. 23, 2004

(54) MAGNETICALLY FASTENABLE MAGNETIC WEDGE SEPARATOR

(75) Inventor: David Roger Miles, Kelowna (CA)

(73) Assignee: Rampage Ventures Inc., George Town (KY)

( * ) Notice: Subject to any disclaimer, the term of this patent is extended or adjusted under 35 U.S.C. 154(b) by 0 days.

(21) Appl. No.: 10/124,228

(22) Filed: Apr. 18, 2002

(65) Prior Publication Data

US 2003/0127370 A1 Jul. 10, 2003

Related U.S. Application Data

(60) Provisional application No. 60/341,216, filed on Dec. 20, 2001.

(51) Int. Cl.[7] ..... B03C 1/00

(52) U.S. Cl. ..... 209/213; 209/214; 209/223.1; 209/225; 209/226

(58) Field of Search ..... 209/213, 214, 209/215, 223.1, 225, 226, 227, 636, 904

(56) References Cited

U.S. PATENT DOCUMENTS

| | | | | | |
|---|---|---|---|---|---|
| 393,348 | A | * | 11/1888 | Atkins | 209/40 |
| 719,741 | A | * | 2/1903 | Burton | 209/223.1 |
| 1,576,640 | A | * | 3/1926 | Ullrich | 209/225 X |
| 2,517,174 | A | | 8/1950 | Bradley | 209/223.1 |
| 2,612,268 | A | * | 9/1952 | Merwin | 209/223.1 |
| 2,654,478 | A | * | 10/1953 | Stem | 209/636 |
| 4,229,288 | A | * | 10/1980 | Akama | 209/212 |
| 4,235,710 | A | * | 11/1980 | Sun | 209/213 |
| 4,565,624 | A | * | 1/1986 | Martinez | 209/227 X |
| 5,100,538 | A | | 3/1992 | Howes | |
| 6,026,966 | A | * | 2/2000 | Svoboda | 209/172.5 |

FOREIGN PATENT DOCUMENTS

| | | |
|---|---|---|
| JP | 2000117143 | 4/2000 |
| WO | WO 92/01617 | 2/1992 |

* cited by examiner

*Primary Examiner*—Donald P. Walsh
*Assistant Examiner*—Joseph C Rodriguez
(74) *Attorney, Agent, or Firm*—Oyen Wiggs Green & Mutala

(57) ABSTRACT

A ferrous metal object separator is removably attachable to a conveyor which transports a moving stream of non-ferrous material (e.g. wood chips) in which some ferrous metal objects (e.g. screws, nuts, broken machinery parts, spikes, nails, steel filings, steel chips, etc.) may be commingled. The separator, which has a non-ferrous body, has an inclined surface extending upwardly from a leading edge to an abrupt trailing edge. A separating magnet embedded adjacent the separator's trailing edge magnetically retains the ferrous metal objects without substantially impeding transport of the non-ferrous material along the conveyor. A fastening magnet embedded in the separator removably magnetically fastens the separator on the conveyor.

11 Claims, 3 Drawing Sheets

MAGNETICALLY FASTENABLE MAGNETIC WEDGE SEPARATOR

REFERENCE TO RELATED APPLICATION

This application claims the benefit of U.S. Provisional Patent Application Serial No. 60/341,216 filed Dec. 20, 2001.

TECHNICAL FIELD

This invention relates to magnetic removal of ferrous metal objects from non-ferrous material.

BACKGROUND

Conveyors are used to transport various materials. As one example, a vibratory or "shaker" conveyor may transport non-ferrous material such as wood chips. The non-ferrous material may be commingled with ferrous metal objects (e.g. screws, nuts, broken machinery parts, spikes, nails, steel filings, steel chips, etc.), which if not separated from the non-ferrous material could be ingested into other processing machinery, potentially damaging the machinery. Screens provided in a shaker conveyor may not be adequate to remove such ferrous metal objects. This invention assists in removal of such ferrous metal objects.

DESCRIPTION

Figure 1:
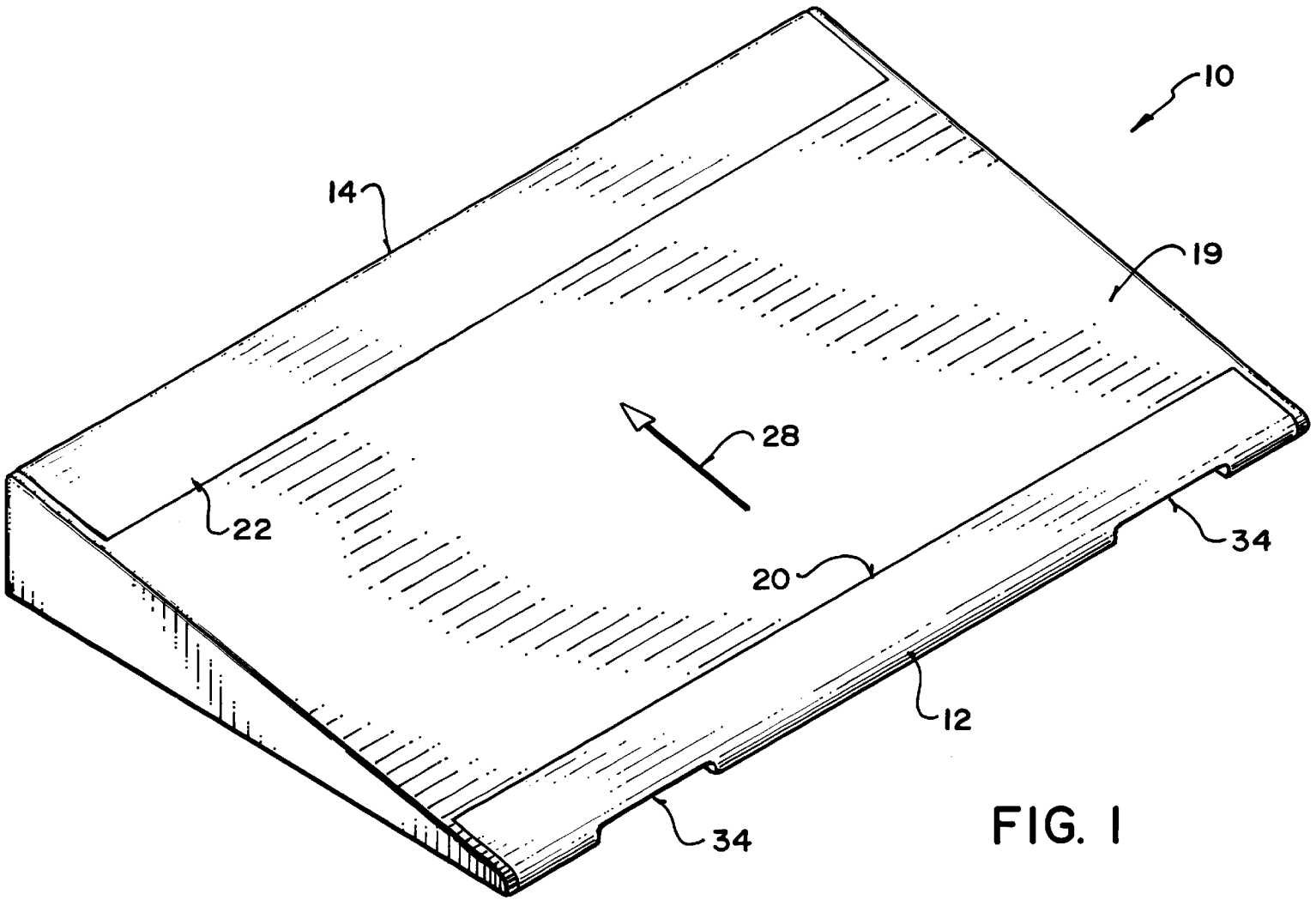
FIG. 1 is an oblique perspective view of a magnetically fastenable magnetic wedge separator in accordance with the invention.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The invention provides a wedge-shaped separator 10 having a leading edge 12 and a trailing edge 14. One or more fastening magnets 16 are embedded within separator 10 to removably magnetically fasten separator 10 atop the ferrous metal surface 18 of a conveyor such as a shaker conveyor, without the need for structural modification or adaptation of the conveyor to receive or retain separator 10. The body of separator 10 is preferably a non-ferrous material such as polyurethane formed in a wedge shape to provide an inclined surface 19 extending upwardly from leading edge 12 to trailing edge 14. Protective caps 20, 22 can be fitted over leading edge 12 and trailing edge 14 respectively. One or more separating magnets 24 are embedded within separator 10, adjacent trailing edge 14. Trailing edge cap 22 is made of a non-ferrous material to minimize interference with the magnetic field 32 of separating magnets 24.

Figure 3:
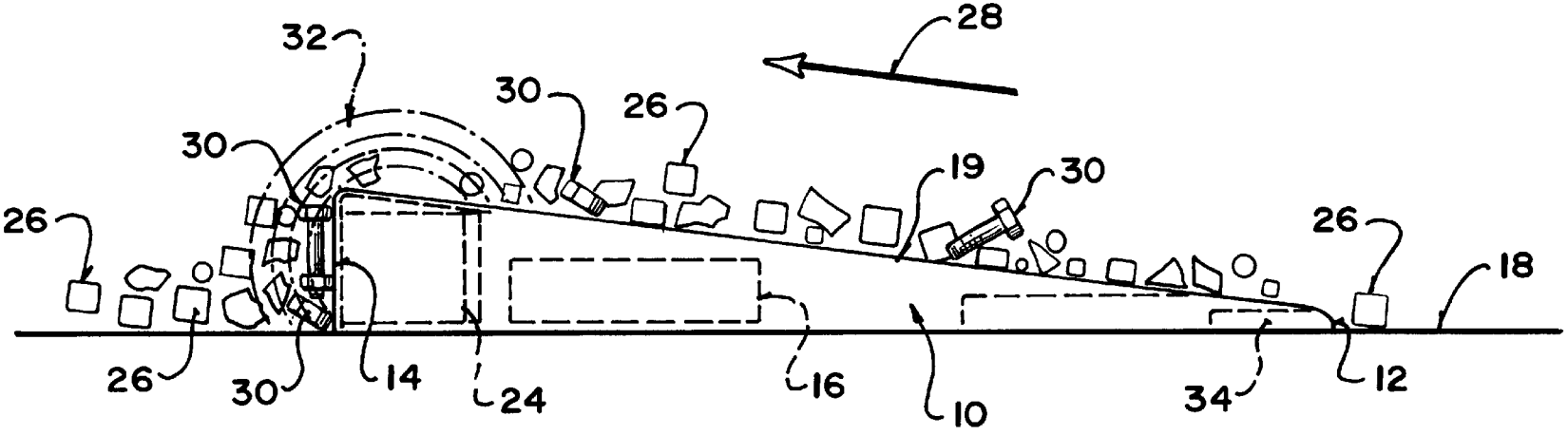
FIG. 3 is a cross-sectional side elevation view of the FIG. 1 apparatus in operation on a shaker conveyor.

Conveyor surface 18 transports a moving stream of non-ferrous material 26 (e.g. wood chips) in the direction indicated by arrow 28 (i.e. from right to left as viewed in FIG. 3). Non-ferrous material 26 may be commingled with some ferrous metal objects 30 (e.g. screws, nuts, broken machinery parts, spikes, nails, steel filings, steel chips, etc.).

Figure 2:
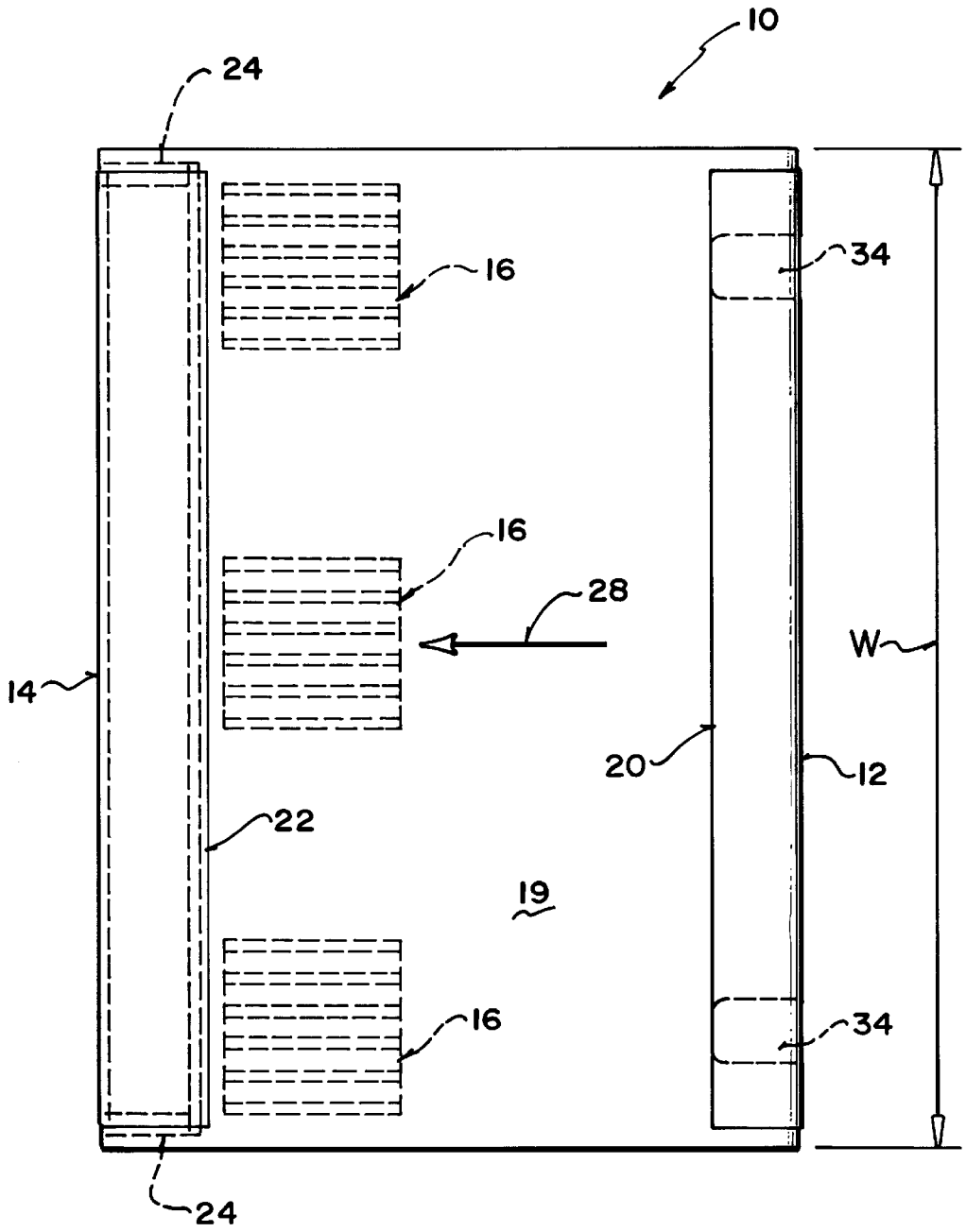
FIG. 2 is a top plan view of the FIG. 1 apparatus.

Commingled non-ferrous material 26 and ferrous metal objects 30 are transported along conveyor surface 18, initially encountering separator 10's leading edge 12 which diverts commingled non-ferrous material 26 and ferrous metal objects 30 from conveyor surface 18 onto separator 10's inclined surface 19. Separator 10 is formed such that its width dimension "W" (FIG. 2) in only slightly smaller than the width of conveyor surface 18, so that substantially all material transported along conveyor surface 18 will be diverted onto separator 10's inclined surface 19. The shaker conveyor's vibratory (shaking) action transports the diverted commingled non-ferrous material 26 and ferrous metal objects 30 across inclined surface 19, toward and over trailing edge 14 which abruptly intersects conveyor surface 18.

Commingled non-ferrous material 26 and ferrous metal objects 30 encounter the magnetic field 32 of separating magnets 24 as the commingled material and objects are transported over trailing edge 14. Depending upon their size, substantially all ferrous metal objects 30 are magnetically attracted toward separating magnets 24 and magnetically retained on separator 10 near trailing edge 14; without substantially impeding transport of non-ferrous material 26 along the conveyor. More particularly, non-ferrous material 26 is unaffected by separating magnets 24, drops off trailing edge 14 onto conveyor surface 18, and is transported along conveyor surface 18 away from separator 10 in the direction of arrow 28 for further processing (not shown). Periodically, at convenient times, any ferrous metal objects 30 magnetically retained on separator 10 can be removed, for example by scraping such objects off separator 10 with a non-metallic scraping tool (not shown).

Instead of using fastening magnets 16 to removably magnetically retain separator 10 atop conveyor surface 18, metal backing plates can be embedded in separator 10 to facilitate welding, bolting, clamping or other attachment of separator 10 to the conveyor. This may however require structural modification or adaptation of the conveyor to receive or retain separator 10. Besides avoiding conveyor modification or adaptation to receive or retain separator 10, fastening magnets 16 allow rapid removal and replacement of separator 10. Specifically, the tip of a pry bar—not shown—can be inserted into one of leading edge recesses 34 (or into another recess—not shown—in trailing edge 14) and force can then be applied to the pry bar to break the magnetic bond between separator 10 and conveyor surface 18. Other techniques known to persons skilled in the art, such as use of a jacking bolt—not shown—can be employed to break the magnetic bond between separator 10 and conveyor surface 18. The capability to rapidly remove separator 10 from the conveyor also simplifies removal of ferrous metal objects 30 magnetically retained on separator 10, after which separator 10 can be quickly returned to service on the conveyor. Fastening magnets 16 also allow separator 10 to be rapidly removed from one conveyor and placed in service on a different conveyor.

Fastening magnets 16 further allow separator 10 to be rapidly removed from one location on a particular conveyor and replaced in service at a different location on the same conveyor. This enables optimization of separator 10's capability to remove ferrous metal objects 30 from non-ferrous material 26, which may be affected by factors such as the particular type of non-ferrous material being conveyed; and, the size, volume or consistency of ferrous metal objects 30 typically commingled within non-ferrous material 26.

What is claimed is:

1. A ferrous metal object separator removably attachable to a ferrous metal surfaced conveyor for transporting a moving stream of commingled non-ferrous material and ferrous metal objects, said separator comprising:

(a) an inclined surface extending upwardly from a leading edge to a trailing edge;

(b) a separating magnet for magnetically retaining said ferrous metal objects without substantially impeding transport of said non-ferrous material along said conveyor; and (c) a fastening magnet for removably magnetically fastening said separator on said ferrous metal surface;

said inclined surface and said separating magnet being stationary parts of said separator, said separator being movable with said conveyor.

2. A separator as defined in claim 1, wherein said separating magnet is embedded in said separator adjacent said trailing edge.

3. A separator as defined in claim 2, wherein said fastening magnet is embedded in said separator.

4. A separator as defined in claim 2, wherein said separator is formed of a non-ferrous material and has a width slightly smaller than the width of said conveyor.

5. A separator as defined in claim 1, wherein said fastening magnet is embedded in said separator.

6. A separator as defined in claim 5, further comprising at least one pry bar recess formed in an outward edge of said separator.

7. A separator as defined in claim 5, further comprising at least one pry bar recess formed in a lower outward edge of said separator.

8. A separator as defined in claim 1, wherein said separator is formed of a non-ferrous material and has a width slightly smaller than the width of said conveyor.

9. A separator as defined in claim 1, further comprising at least one pry bar recess formed in an outward edge of said separator.

10. A separator as defined in claim 1, further comprising at least one pry bar recess formed in a lower outward edge of said separator.

11. A method of removing ferrous metal objects from a moving stream of non-ferrous material commingled with said ferrous metal objects, said method comprising:

(a) removably magnetically fastening said inclined surface in a fixed position relative to said moving stream;

(b) diverting said moving stream across an inclined surface having an abrupt trailing edge; and (c) applying a magnetic field near said trailing edge to magnetically retain substantially all said ferrous metal objects near said trailing edge without substantially impeding movement of said non-ferrous material;

while maintaining said inclined surface stationary relative to said separating magnet.

* * * * *